US010828792B2

(12) United States Patent
Hagström

(10) Patent No.: US 10,828,792 B2
(45) Date of Patent: Nov. 10, 2020

(54) LOCK-BLADE KNIFE FOR COOKING PURPOSES

(71) Applicant: Fenix Outdoor Development and CSR AG, Zug (CH)

(72) Inventor: Magnus Hagström, Tyresö (SE)

(73) Assignee: Fenix Outdoor Development and CSR AG, Zug (CH)

( * ) Notice: Subject to any disclaimer, the term of this patent is extended or adjusted under 35 U.S.C. 154(b) by 0 days.

(21) Appl. No.: 16/099,933

(22) PCT Filed: May 9, 2017

(86) PCT No.: PCT/EP2017/061023
§ 371 (c)(1),
(2) Date: Nov. 8, 2018

(87) PCT Pub. No.: WO2017/194519
PCT Pub. Date: Nov. 16, 2017

(65) Prior Publication Data

US 2019/0143545 A1 May 16, 2019

(30) Foreign Application Priority Data

May 9, 2016 (DE) ..... 10 2016 207 949

(51) Int. Cl.
*B26B 11/00* (2006.01)
*B26B 1/04* (2006.01)
(Continued)

(52) U.S. Cl.
CPC ..... *B26B 11/006* (2013.01); *B26B 1/04* (2013.01); *B26B 1/042* (2013.01); *B67B 7/30* (2013.01); *B67B 7/44* (2013.01); *B67B 2007/303* (2013.01)

(58) Field of Classification Search
CPC ..... B26B 11/006; B26B 1/04; B26B 1/042; B67B 7/44; B67B 2007/303
See application file for complete search history.

(56) References Cited

U.S. PATENT DOCUMENTS 4,606,123 A * 8/1986 Wrench ..... B26B 11/006 30/153
4,776,094 A * 10/1988 Glesser ..... B26B 11/006 30/160
(Continued)

FOREIGN PATENT DOCUMENTS

CN 2096456 U 2/1992
CN 204585251 U 8/2015
(Continued)

OTHER PUBLICATIONS

International Written Opinion for International Application No. PCT/EP2017/061023 dated Aug. 2, 2017, 5 pages.
(Continued)

*Primary Examiner* — Omar Flores Sanchez
(74) *Attorney, Agent, or Firm* — TraskBritt

(57) ABSTRACT

A lock-blade knife for cooking purposes comprises a housing, a blade pivotally attached to the housing and a locking mechanism. The blade is rotatable relative to the housing between a closed position and a least one cutting position. The locking mechanism is configured to lock the blade in the at least one cutting position. The locking mechanism comprises a biasing member, an engagement structure, and a grasping member. The engagement structure is disposed on the blade, and the grasping member is displaceable from a locking position into a releasing position. The grasping member is biased into the releasing position. The grasping member is in engagement with the engagement structure in the locking position when cutting to lock the blade in position. The blade is rotatable between the cutting position
(Continued)

and the closed position when the grasping member is manually displaced into the releasing position.

14 Claims, 11 Drawing Sheets

(51) Int. Cl.
*B67B 7/46* (2006.01)
*B67B 7/44* (2006.01)

(56) References Cited

U.S. PATENT DOCUMENTS 5,799,400 A * 9/1998 Glesser ..... B26B 1/042 30/155
9,656,397 B2 * 5/2017 Huhtala ..... B26B 1/08
2003/0140424 A1 * 7/2003 Rivera ..... A45D 26/0066 7/128
2004/0255389 A1 * 12/2004 Seber ..... B25F 1/003 7/128
2006/0150422 A1 * 7/2006 Grice ..... B26B 1/042 30/160
2019/0134433 A1 * 5/2019 Allen ..... B26B 1/042
2019/0202073 A1 * 7/2019 Huang ..... B26B 1/04

FOREIGN PATENT DOCUMENTS

DE 3740374 A1 6/1989
FR 2843907 A1 3/2004

OTHER PUBLICATIONS

International Search Report for International Application No. PCT/EP2017/061023 dated Aug. 2, 2017, 4 pages.

* cited by examiner

LOCK-BLADE KNIFE FOR COOKING PURPOSES

CROSS-REFERENCE TO RELATED APPLICATIONS

This application is a national phase entry under 35 U.S.C. § 371 of International Patent Application PCT/EP2017/061023, filed May 9, 2017, designating the United States of America and published in English as International Patent Publication WO 2017/194519 A1 on Nov. 16, 2017, which claims the benefit under Article 8 of the Patent Cooperation Treaty to German Patent Application Serial No. 10 2016 207 949.2, filed May 9, 2016.

TECHNICAL FIELD

This disclosure relates to a lock-blade knife for cooking purposes. In general, such lock-blade knives comprise a housing, a blade pivotally attached to the housing, and a locking mechanism. The blade is pivotable between a closed position and at least one cutting position. In the closed position, the cutting edge of the knife is disposed within the housing, so that nothing is inadvertently cut. In the cutting position, the knife can be used to cut things, e.g., legumes for preparing food. The locking mechanism is configured to lock the blade in the cutting position so that the safety during usage of the knife is improved. Accidental movement of the blade from the cutting position into the closed position is prevented by the locking mechanism.

BACKGROUND

The locking mechanisms known from the prior art generally work well, however, they are associated with drawbacks, especially when the lock-blade knife is used during extensive expeditions to remote locations. During such expeditions, the locking mechanism could fail due to soiling, wear or any other malfunction. Especially in the case where the user relies on the safe functioning of the locking mechanism, the blade may be inadvertently moved from the cutting position. This greatly increases the risk of injuries. As a matter of course, a wound caused by cutting in remote locations can lead to dangerous situations, e.g., blood poisoning or the like.

Thus, there is increased need to provide a lock-blade knife for cooking purposes especially suitable for extensive outdoor usage that has a reliable and uncomplicated lock mechanism. In particular, it is desirable to provide a lock mechanism that is not prone to soiling and wear and is easy to clean so that the functionality of the lock mechanism can be maintained even during extensive expeditions.

BRIEF SUMMARY

The lock-blade knife according to this disclosure is characterized over the prior art in that the locking mechanism comprises a biasing means, an engagement structure, and a grasping means. According to the disclosure, the engagement structure is disposed on the blade, and the grasping means is displaceable relative to the housing from a locking position into a releasing position. Further, the grasping means is biased into the locking position by the biasing means. According to the disclosure, the grasping means is in engagement with the engagement structure in the locking position when the blade is in the cutting position, so that the blade is locked in the cutting position. According to the disclosure, the blade is rotatable between the cutting position and the closed position when the grasping means is manually displaced into the releasing position.

Thus, for moving the blade from the cutting position into the closed position, the grasping means is displaced relative to the housing from the locking position into the releasing position against the biasing force of the biasing means. In doing so, the grasping means is brought out of engagement with the engagement structure provided on the blade so that the blade is rotatable from the cutting position into the closed position. The grasping means returns to its initial position due to the biasing force of the biasing means, e.g., when the user releases the grasping means. For unlocking the locking mechanism, the user manually displaces the grasping means from the locking position to the releasing position so that the grasping means is disengaged from the engagement structure. Thus, the blade could then be freely rotated into the closed position. Preferably, the grasping means is provided on an end portion of the biasing means.

As the engagement structure is provided on the blade, and preferably is even integrally formed with the blade, it is made, e.g., of hardened steel being highly wear resistant. In addition, as all relevant parts of the locking mechanism are accessible, they could easily be cleaned when soiled so that the functionality of the locking mechanism is not corrupted by soiling or foreign matter. Furthermore, as all relevant parts are accessible, the user could easily see whether the locking mechanism is, e.g., soiled so that its safety function might be limited. Thus, the user could then either decide to easily clean the lock-blade knife or to pay special attention when using the knife by being aware of the latent danger. Thus, the risk of accidental movement of the blade from the cutting position during usage of the inventive lock-blade knife is greatly reduced.

Preferably, the locking mechanism comprises a slope portion, wherein the grasping means is displaced from the locking position into the releasing position, in that the grasping means slides along the slope portion during rotation of the blade from the closed position into the cutting position. Hence, when rotating the blade from the closed position into the cutting position, the slope portion comes into contact with the grasping means before the blade is in the cutting position. Rotating the blade further into the direction of the cutting position displaces the grasping means, as the latter one slides along the slope portion to a direction relative outwardly of the housing. Thus, the grasping means is displaced from the locking position into the releasing position. The slope portion is preferably disposed on the blade, wherein the engagement structure is preferably directly provided in continuation with the slope portion when seen in the rotation direction. Thus, the grasping means engages the engagement structure as it returns into the locking position due to the biasing force of the biasing means. Thus, safety of the lock-blade knife is increased as the blade is automatically locked in the cutting position. In addition, comfort is increased as the user does not have to manually displace the grasping means when the blade is moved to the cutting position.

Preferably, the engagement structure is an engagement slot and the grasping means is at least partially disposed within the engagement slot in the locking position, when the blade is in the cutting position. The biasing means then exerts a biasing force on the blade via the grasping means. Thus, the blade is securely held in the cutting position and accidental movement from the cutting position is prevented.

In addition, the engagement slot is easily cleanable so that malfunction of the locking mechanism can virtually be inhibited.

Preferably, the housing is composed of a first handle portion and a second handle portion, wherein a storage space is formed between the first handle portion and the second handle portion, so that the blade is at least partially disposed within the storage space in the closed position. In particular, the cutting edge of the blade is disposed in the storage space. Furthermore, it is preferable in this regard that the first handle portion and the second handle portion are attached to each other by a first fastening means and a second fastening means, so that the first handle portion is spaced from the second handle portion. Thus, the housing is open to two sides and no interior space is formed where foreign matter or other unwanted material can accumulate. This further facilitates cleaning of the lock-blade knife and prevents the locking mechanism from getting soiled. In addition, as accumulation of organic material within the housing is greatly reduced, the overall hygienic situation for the user is ameliorated.

Preferably, the first fastening means further constitutes a supporting means for the biasing means. It is further preferable that the second fastening means further constitutes a pivot shaft for the blade. Thus, the biasing means is provided to the first fastening means to bias the grasping means toward the locking position. In addition, the number of parts of the lock-blade knife is greatly reduced in case no separate supporting means and/or no separate pivot shaft is provided. Thus, the complexity of the lock-blade knife and the weight thereof is reduced.

Preferably, the biasing means is a member having a first end portion and a second end portion, the first end portion preferably being engaged to the first fastening means. Preferably, the grasping means is disposed on the second end portion. Preferably, the biasing means is a longitudinal member. Thus, the biasing means can be a spring-like member wherein the biasing force is established by the elasticity of the longitudinal biasing means. Thus, the liability of the biasing means to malfunctions, e.g., a brittle fracture, is greatly reduced. In addition, the biasing means is easily cleanable.

Preferably, a retaining pin is disposed in the housing, wherein the biasing means is at least partially retained by the retaining pin in a position within the housing, when the grasping means is displaced from the locking position into the releasing position. Thus, the retaining pin abuts against the biasing means at least in the case where the grasping means is manually displaced into the releasing position. Thus, the biasing force of the biasing means is intensified. In addition, the retaining pin ensures that the biasing means does not rotate.

Preferably, the blade further comprises a second engagement structure. The grasping means is in engagement with the second engagement structure in the locking position when the blade is in the closed position, so that the blade is locked in the closed position. As such, when the blade is in the closed position, the grasping means is biased into the locking position by the biasing means and engages the second engagement structure. Thus, safety of the lock-blade knife is greatly increased as accidental movement of the blade from the closed position is inhibited. This in turn allows for smooth rotational capability of the blade relative to the housing, as the locking function does not need to be warranted via, e.g., increased friction.

Preferably, the blade comprises a guide slot engaging an abutment pin when the blade is rotated from the closed position into the cutting position, wherein the abutment pin abuts at an end of the guide slot when the blade is in the cutting position so that the rotational movement of the blade relative to the housing is limited. Thus, due to the physical barrier, unintentional over rotation of the blade is inhibited and any possible malfunction associated therewith is inhibited. Thus, functionality of the lock-blade knife having an abutment pin and a guide slot is ensured.

Preferably, the guide slot is formed as a part of a can-opener portion, wherein the can-opener portion is positioned outside of the housing when the blade is in the closed position. Thus, the can-opener provides a further functionality to the lock-blade knife being advantageous as a separate can-opener tool does not need to be carried, e.g., to the expedition. Furthermore, as the guide slot is formed as a part of the can-opener portion, a separate can-opener portion is not necessary.

Alternatively, the blade further comprises a can-opener portion, wherein the can-opener portion is positioned outside of the housing when the blade is in the closed position. In other words, the tin-opener portion can be provided separately of the guide slot and the abutment pin. Thus, the tin-opener portion can also be provided in case the guide slot and the abutment pin are omitted, e.g., for cost reasons.

Preferably, the biasing means is integrally formed with the grasping means. Thus, the biasing means and the grasping means are a one-piece unitary member. Preferably, the biasing means is made of a bent spring steel wire. Thus, the biasing force is established due the elasticity of the spring steel wire bent into shape.

BRIEF DESCRIPTION OF THE DRAWINGS

Specific embodiments of the disclosure will now be described below, by way of example, with reference to accompanying drawings, in which.

DETAILED DESCRIPTION

Figure 1:
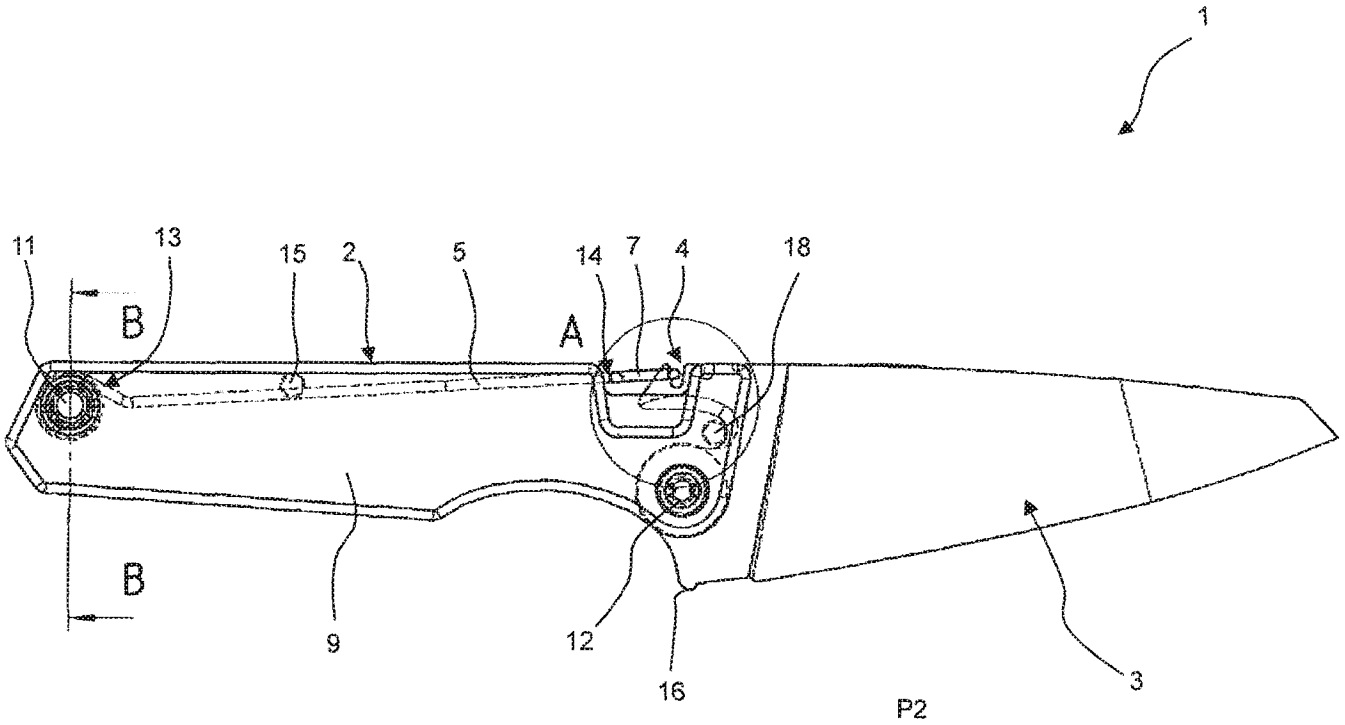
FIG. 1 is a side view of a lock-blade knife according to the present disclosure.
Figure 2A:
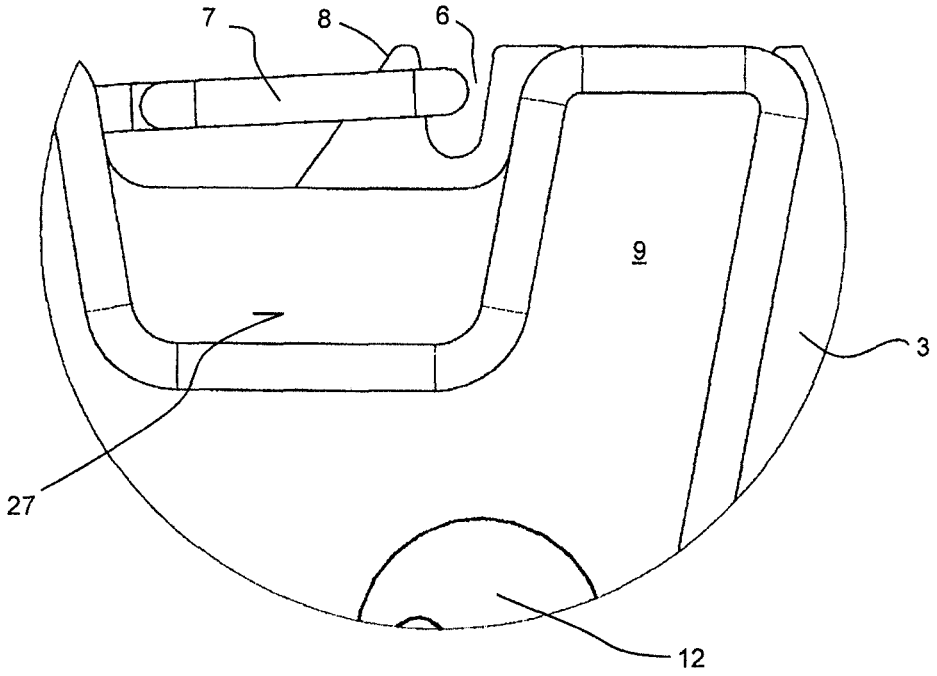
FIG. 2A is a detailed view of detail A of FIG. 1 without hidden lines and FIG. 2B is a detail view of detail A of FIG. 1 with hidden lines drawn as dashed lines.
Figure 2B:
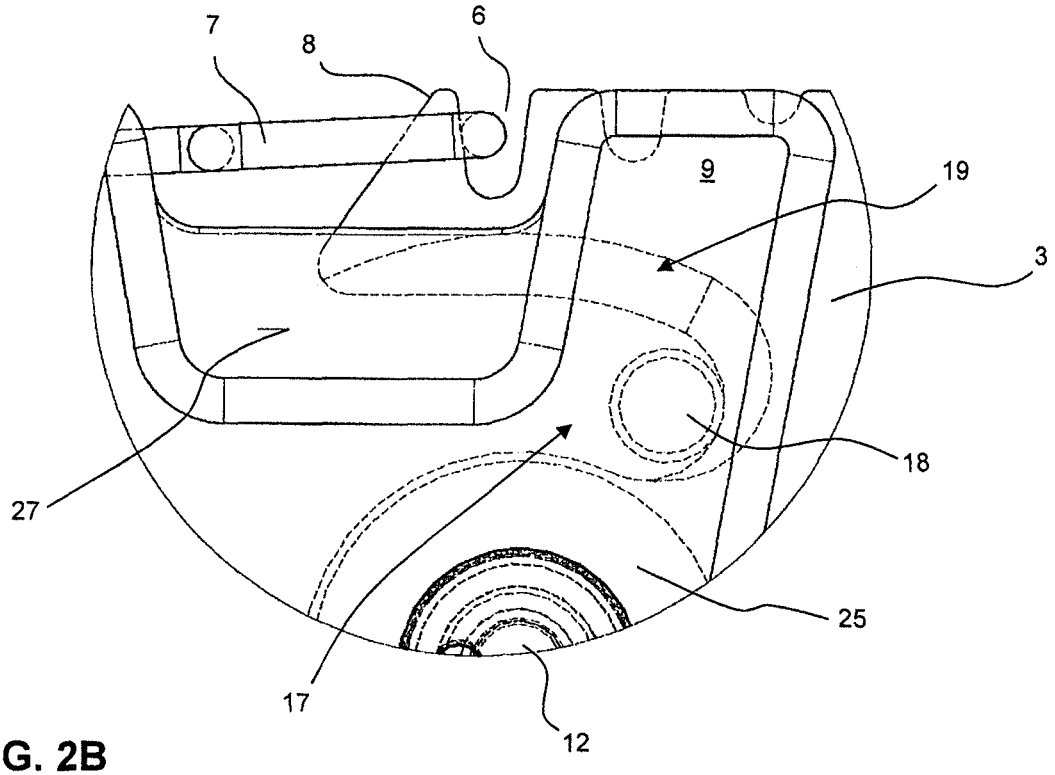
Figure 3:
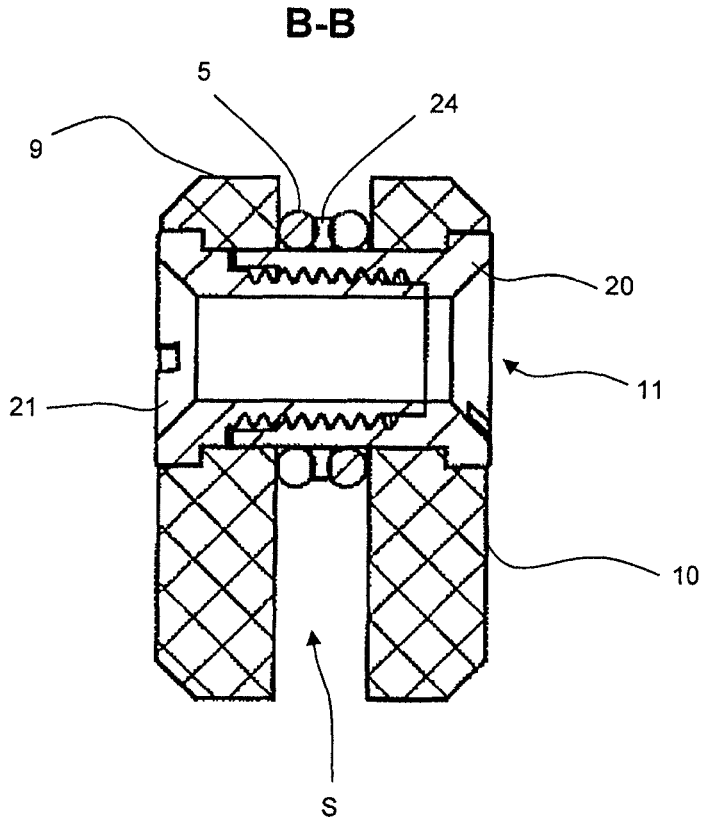
FIG. 3 is a cross-sectional view along the line B-B of FIG. 1.
Figure 5:
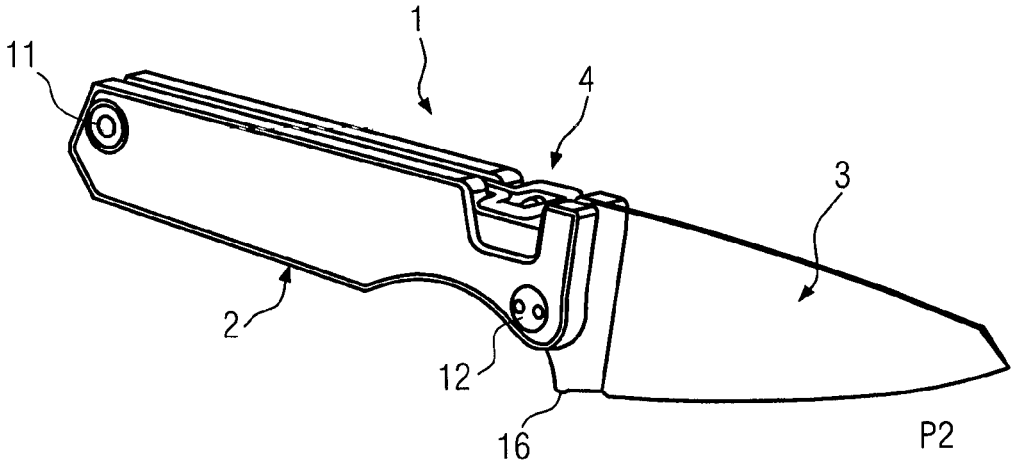
FIG. 5 is perspective view of the lock-blade knife of FIG. 1 in the cutting position.
Figure 6:
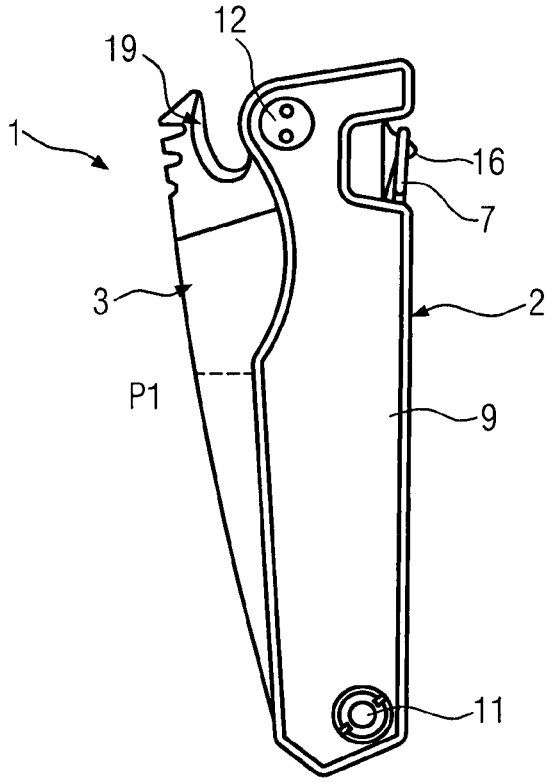
FIG. 6 is a side view of the lock-blade knife of FIG. 1 in the closed position.
Figure 7:
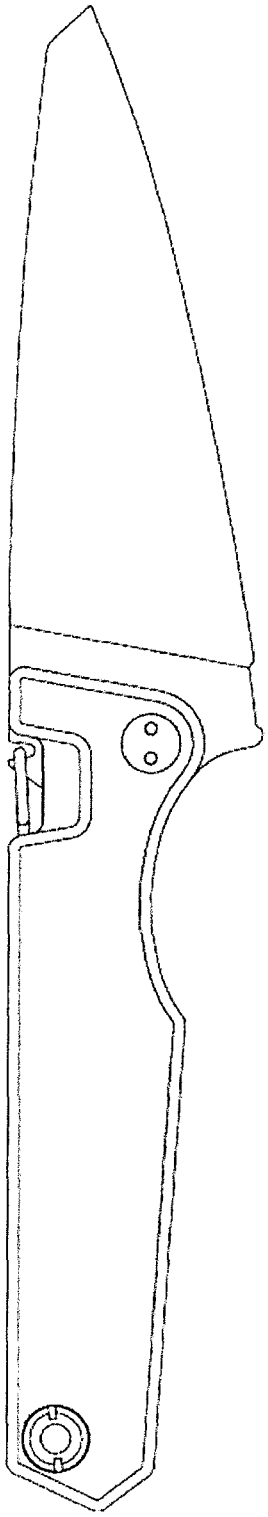
FIG. 7 is a side view of the lock-blade knife of FIG. 1 in the cutting position.
Figure 8:
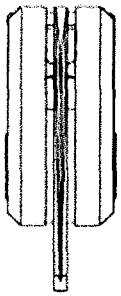
FIG. 8 is front view of the lock-blade knife of FIG. 1 in the cutting position.
Figure 9:
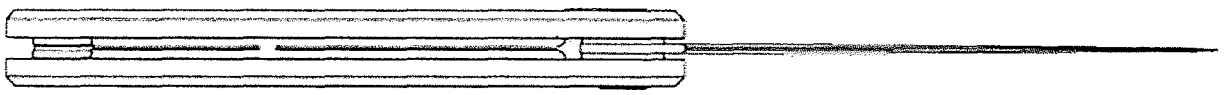
FIG. 9 is a bottom view of the lock-blade knife of FIG. 1 in the cutting position.
Figure 10:
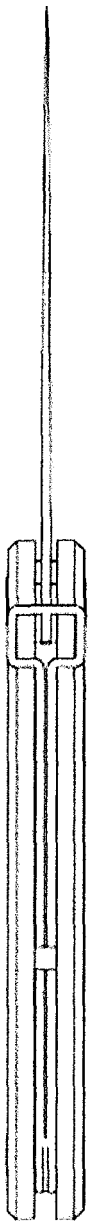
FIG. 10 is a top view of the lock-blade knife of FIG. 1 in the cutting position.
Figure 11:
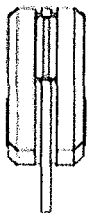
FIG. 11 is a back view of the lock-blade knife of FIG. 1 in the cutting position.

As shown in the figures, the lock-blade knife 1 comprises a housing 2, a blade 3 and a locking mechanism 4. The blade 3 is pivotally attached to the housing 2 so that it can be rotated between a closed position P1 and a cutting position P2. In FIG. 6, the blade 3 is shown in the closed position P1, whereas FIGS. 1 and 5 show the blade in the cutting position P2. As can be seen in FIGS. 2A and 2B, the knife further comprises a locking mechanism 4 that is configured to lock the blade 3 in the cutting position P2. The housing 2 comprises a first handle portion 9 and a second handle portion 10, which are attached to each other by a first fastening means 11 and a second fastening means 12. When attached to each other, a storage space S is formed in the housing 2. When the blade 3 is in the closed position, the blade 3 is partially disposed within the storage space S. In particular, the cutting edge of the blade 3 is disposed within the storage space S. Furthermore, as can be seen in FIG. 3, the first handle portion 9 and the second handle portion 10 are spaced from each other so that the storage space S is open to two sides.

Figure 4:
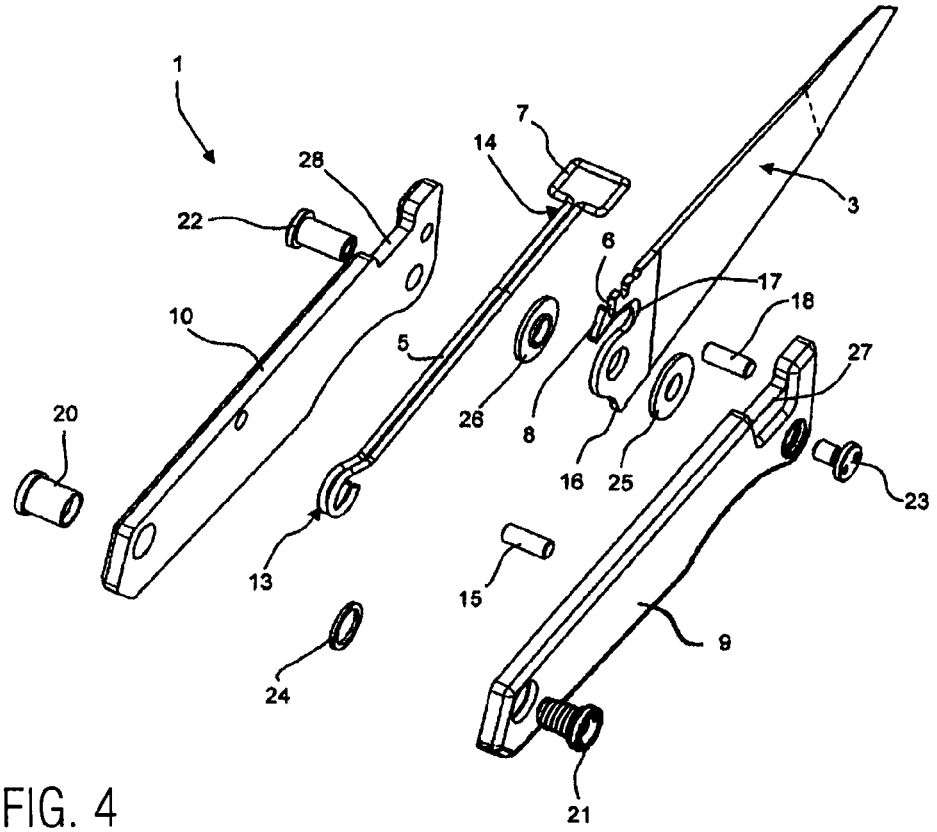
FIG. 4 is an exploded view of the lock-blade knife of FIG. 1.

As can be seen in FIG. 5, the first fastening means 11 is provided on the rear end of the housing 2 and comprises a first bushing member 20 and a first screw member 21 (see FIG. 4). For saving weight, the first screw member 21 is a hollow member with an outer threading engaging an inner threading provided on the first bushing member 20. Similarly, the second fastening means 12 is provided on the front end of the housing 2, i.e., the end the blade 3 is rotationally attached to housing 2 as will be described later. The second fastening means 12 comprises a second bushing member 22 and a second screw member 23 (see FIG. 4). The second fastening means 12 also constitutes the pivot shaft for the blade 3 in that the second bushing member 22 is supporting the blade 3.

With continued reference to FIG. 4, two shim members 25, 26 are provided on each side of the blade 3 abutting against the respective handle portions 9 and 10, as can be seen in FIG. 4. The shim members 25, 26 set the correct distance of the blade 3 relative to the first handle portion 9 and the second handle portion 10 and further reduce the friction when the blade 3 is rotated.

To limit the rotational movement of the blade 3 relative to the housing 2, the blade comprises a guide slot 17 that extends in a slight curvature along the longitudinal axis of the blade 3 in the area of the rotational axis. An abutment pin 18 is provided between the first handle portion 9 and the second handle portion 10, which abuts against an end of the guide slot 17 when the blade 3 is rotated into the cutting position P2. In particular, when rotating the blade 3 from the closed position P1 into the cutting position P2, the guide slot 17 is rotated together with the blade 3 and encloses the abutment pin 18 during rotation. Rotation is terminated when the abutment pin 18 abuts against the end of the guide slot 17 as shown in FIG. 2B. Thus, the cutting position P2 is then reached and defined.

Next, the locking mechanism 4 will be described. The locking mechanism 4 comprises a biasing means 5 integrally formed with a grasping means 7. Further, the locking mechanism 4 comprises an engagement structure 6 in the form of an engagement slot being disposed on the blade 3. In addition, a sloped portion 8 is provided on the blade 3 disposed directly adjacent to the engagement slot 6, as shown in FIGS. 2A and 2B. The biasing means 5 is a bent spring steel wire having a first end portion 13 and a second end portion 14, wherein the first end portion 13 is formed in a hook-like manner, as can be seen in FIG. 4. The first end portion 13 is supported on the first fastening member 11 by a shim member 24, as shown in FIG. 4. Thus, the first fastening member 11 constitutes a supporting means for the biasing means 5, in particular, for the hook-like formed first end portion 13. In addition, a retaining pin 15 is provided between the first handle portion 9 and the second handle portion 10. The retaining pin 15 retains the biasing means 5 partially within the housing 2, so that a rotation of the biasing means 5 about the supporting means (i.e., the first fastening means 11) is inhibited.

As can be seen in FIGS. 2A and 2B, the grasping means 7 is in engagement with engagement slot 6 when the blade 3 is in the cutting position P2. Thus, the grasping means 7 is in the locking position. In addition, the blade 3 comprises a second engagement structure 16 (FIGS. 4 and 5) being disposed on the opposite side of the blade 3 relative to the engagement slot 6. The second engagement means 16 is a nose-like member protruding from the blade 3.

Furthermore, to allow for accessibility of the grasping means 7, the first handle portion 9 and the second handle portion 10 each have a recessed portion 27, 28. As can be seen in FIGS. 2A and 2B, the grasping means 7 is disposed within the recessed portions 27, 28 so that the grasping means 7 can easily be manually displaced as will be described below.

Now, the locking and unlocking function will be described. First, the blade 3 is in the closed position P1 as shown in FIG. 6. The grasping means 7 is in the locking position and engages behind the second engagement structure 16 so that the blade 3 cannot be rotated. The user now manually displaces the grasping means 7 from the locking position into the releasing position relative to the housing 2. In other words, the grasping means 7 is moved away from the housing 2 against the biasing force of the biasing means 5. Thus, the engagement between the grasping means 7 and the second engagement structure 16 is released. The blade 3 can now be rotated out of the closed position P1.

The blade 3 is manually rotated into the cutting position P2. During rotation, the grasping means 7 abuts against the sloped portion 8. By rotating the blade 3 further, the grasping means 7 slides along the sloped portion 8 and is thus displaced from the locking position against the biasing force of the biasing means 5. The rotation of the blade 3 is limited when the abutment pin 18 abuts the end of the guide slot 17. Upon reaching the cutting position P2, the grasping means 7 snaps into the engagement slot 6 due to the biasing force of the biasing means 5. The grasping means 7 is in the locking position and locks the blade 3 from rotating out of the cutting position P2, as shown in FIGS. 2A and 2B. Further, a tension caused by the biasing means 5 acts on the grasping means 7, so that a secure locking is achieved.

To move the blade 3 from the cutting position P2 into the closed position P1, the use manually displaces the grasping means 7 against the biasing forces of the biasing means 5 from the locking position into the releasing position. In doing so, the engagement between the grasping means 7 and the engagement slot 6 is released and the blade 3 can be rotated out of the cutting position P2 into the closed position P1. When the blade is in the closed position P1, the user releases the grasping means 7 and the grasping means 7 returns to the locking position due to the biasing force of the biasing means 5. Therewith, the grasping means 7 engages with the second engagement structure 16 to lock the blade 3 in the closed position.

Furthermore, the blade 3 comprises a can-opener portion 19. In this embodiment, the can-opener portion is formed by the guide slot 17 and the portion carrying the engagement slot 6 and the sloped portion 8 (FIG. 4). As can be seen in FIG. 6, the can-opener portion 19 is disposed outside the housing 2 when the blade 3 is in the closed position P1. Thus, the user can utilize the can-opener portion 19 to open tins.

Figure 12:
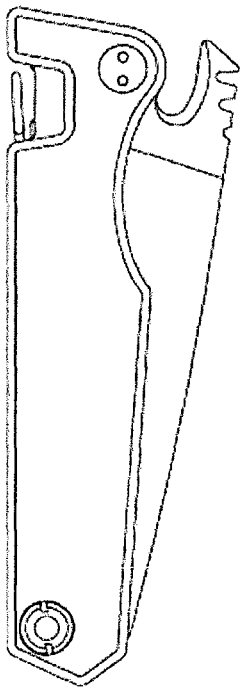
FIG. 12 is a side view of the lock-blade knife of FIG. 1 in the closed position.
Figure 13:
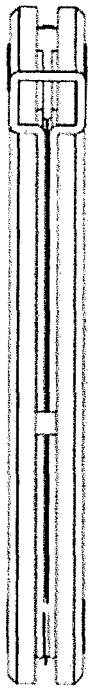
FIG. 13 is a top view of the lock-blade knife of FIG. 1 in the closed position.

A second embodiment without the second engagement means engaging the grasping means is shown in FIG. 12 and FIG. 13.

LIST OF REFERENCE SIGNS

1 lock-blade knife
2 housing
3 blade
4 locking mechanism
5 biasing means
6 engagement structure
7 grasping means
8 sloped portion
9 first handle portion
10 second handle portion
11 first fastening means/supporting means
12 second fastening means/pivot shaft
13 first end portion
14 second end portion
15 retaining pin
16 second engagement structure
17 guide slot
18 abutment pin
19 can-opener portion
20 bushing member of first fastening means
21 screw member of first fastening means
22 bushing member of second fastening means
23 screw member of second fastening means
24 shim member
25 shim member
26 shim member
27 recessed portion
28 recessed portion
P1 closed position
P2 cutting position
S storage space

The invention claimed is:

1. A lock-blade knife for cooking purposes, comprising:
a housing;
a blade pivotally attached to the housing, the blade being rotatable relative to the housing between a closed position and at least one cutting position; and
a locking mechanism configured to lock the blade in the at least one cutting position, the locking mechanism comprising:
a biasing member, wherein the biasing member comprises a bent sprint steel wire;
an engagement structure disposed on the blade; and
a grasping member being displaceable relative to the housing from a locking position into a releasing position, the grasping member being biased into the locking position by the biasing member, the grasping member being in engagement with the engagement structure in the locking position when the blade is in the at least one cutting position so that the blade is locked in the at least one cutting position, and wherein the blade is rotatable between the at least one cutting position and the closed position when the grasping member is manually displaced into the releasing position.

2. The lock-blade knife of claim 1, wherein the locking mechanism comprises a slope portion, the grasping member configured to slide along the slope portion during rotation of the blade from the closed position into the at least one cutting position while the grasping member is displaced from the locking position into the releasing position.

3. The lock-blade knife of claim 2, wherein the engagement structure is an engagement slot, the grasping member is at least partially disposed within the engagement slot in the locking position when the blade is in the at least one cutting position, and the biasing member exerts a biasing force on the blade via the grasping member.

4. The lock-blade knife of claim 1, wherein the housing comprises a first handle portion and a second handle portion, the first handle portion and the second handle portion defining a storage space therebetween, the blade being at least partially disposed within the storage space in the closed position.

5. The lock-blade knife of claim 4, wherein the first handle portion and the second handle portion are attached together by a first fastening member and a second fastening member, the first fastening member and the second fastening member disposed in a space separating the first handle portion from the second handle portion.

6. The lock-blade knife of claim 5, wherein the first fastening member supports the biasing member, and the second fastening member comprises a pivot shaft for the blade.

7. The lock-blade knife of claim 5, wherein the biasing member comprises a longitudinal member having a first end portion and a second end portion, the first end portion being engaged to the first fastening member, and wherein the grasping member is disposed on the second end portion.

8. The lock-blade knife of claim 1, wherein a retaining pin is disposed in the housing, the biasing member being at least partially retained by the retaining pin in a position within the housing when the grasping member is displaced form the locking position into the releasing position.

9. The lock-blade knife of claim 1, wherein the blade further comprises a second engagement structure, the grasping member being in engagement with the second engagement structure in the locking position when the blade is in the closed position to lock the blade in the closed position.

10. The lock-blade knife of claim 1, wherein the blade comprises a guide slot engaging an abutment pin when the blade is rotated from the closed position into the at least one cutting position, the abutment pin abutting an end of the guide slot when the blade is in the at least one cutting position to limit further rotational movement of the blade relative to the housing.

11. The lock-blade knife of claim 10, wherein the guide slot comprises a portion of a can-opener feature, the can-opener feature being positioned outside of the housing when the blade is in the closed position.

12. The lock-blade knife of claim 1, wherein the blade further comprises a can-opener feature, the can-opener feature being positioned outside of the housing when the blade is in the closed position.

13. The lock-blade knife of claim 1, wherein the biasing member is integrally formed with the grasping member.

14. The lock-blade knife of claim 1, wherein the engagement structure is an engagement slot, the grasping member is at least partially disposed within the engagement slot in the locking position when the blade is in the at least one cutting position, and the biasing member exerts a biasing force on the blade via the grasping member.

* * * * *